US005839493A

United States Patent [19]

Quasius

[11] Patent Number: 5,839,493

[45] Date of Patent: Nov. 24, 1998

[54] ROLLING SHUTTER AND RETENTION ASSEMBLY

[75] Inventor: James R. Quasius, Clearwater, Fla.

[73] Assignee: Valco Enterprises, Ltd., Tampa, Fla.

[21] Appl. No.: 800,308

[22] Filed: Feb. 14, 1997

[51] Int. Cl.[6] ..... E06B 9/08

[52] U.S. Cl. ..... 160/133; 160/273.1

[58] Field of Search ..... 160/133, 271, 160/272, 273.1, 1, 7, 8, 9, 232, 235, 236

[56] References Cited

U.S. PATENT DOCUMENTS

| | | | |
|---|---|---|---|
| 1,918,415 | 7/1933 | Miller | 160/273.1 X |
| 3,292,685 | 12/1966 | Clark | 160/264 X |
| 3,489,200 | 1/1970 | Recchione | 160/133 |
| 3,850,465 | 11/1974 | Hill et al. | 160/133 X |
| 4,282,920 | 8/1981 | Kremm | 160/133 |
| 4,343,340 | 8/1982 | Paule | 160/232 |
| 4,432,591 | 2/1984 | Rinkewich | 160/232 X |
| 4,628,982 | 12/1986 | Labelle | 160/235 |
| 4,738,296 | 4/1988 | Hatch | 160/133 |
| 4,972,894 | 11/1990 | Machill | 160/235 |
| 5,165,746 | 11/1992 | Teigen | 160/236 X |
| 5,377,738 | 1/1995 | Cooper | 160/133 |
| 5,657,805 | 8/1997 | Magro | 160/133 |

*Primary Examiner*—David M. Purol

*Attorney, Agent, or Firm*—Carlton Fields; Andrew C. Greenberg

[57] ABSTRACT

A shutter system for a portal opening such as a window or door including a flexible barrier made of a plurality of interlocking flexible barrier slats having stop elements attached to barrier slat ends, a mounting assembly having guide tracks disposed on each side of the portal opening and a retention assembly having retention surfaces fixedly attached to the mounting assembly facing away from each end of the barrier at an acute angle for engaging the stop elements such that when displacement forces cause the flexible barrier to flex, the stop elements are displaced to engage the retention surfaces at an initial angle to anchor the ends of the flexible barrier within the guide tracks such that the engagement angle decreases as the flexible barrier flexes further until the stop elements flushly engage the retention surface.

12 Claims, 4 Drawing Sheets

ROLLING SHUTTER AND RETENTION ASSEMBLY

BACKGROUND OF THE INVENTION

This invention relates to a shutter for selectably covering a portal opening such as a window or door and a retention assembly to operatively mount the shutter to the portal.

DESCRIPTION OF THE PRIOR ART

Rolling storm and security shutters are well known in the art. Such shutters selectably cover windows, doors and other portal openings for protection against elements or intruders. Systems typically comprise a shutter assembly of interlocking plastic or metal slats disposed between a pair of guide tracks attached to opposite sides of the portal opening configured to permit the shutter assembly to be stored in a rolled up position when the portal is to be open and to allow the slats to freely slide along the guide tracks to a closed position when the portal is to be enclosed. In the closed position, the guide tracks further serve to hold the shutter assembly in place to reduce unwanted lateral movement due to displacement forces applied by burglars or the elements.

One limitation of the prior art is that sufficiently strong displacement forces against the shutter cause the slats to bow excessively thereby dislodging from the guide tracks and exposing the portal to ambient. Subsequent prior art endeavored to correct this problem by adding end retention means to resist the bowing forces and more securely hold the slats within the guide tracks.

U.S. Pat. No. 5,253,694 (Bernardo) teaches a rolling shutter that includes slat end pieces riveted to the end of each slat, each end piece including a pair of flanges connected by a web, forming a slot keyed to parallel slat retention fins extending inwardly from and perpendicular to the walls of the guide tracks to retain the slat within the guide tracks.

International Publication WO 87/03641 discloses a shutter comprising roller blind slats including steel bars having pins with pinheads at each end, either riveted to each slat or extending therethrough. The pinheads are held inside guide tracks by two opposing parallel slat retention fins extending inwardly from and perpendicular to the walls of the guide tracks. However, these end retention means exhibit several shortcomings such as when the shutter is exposed to high displacement forces produced by hurricane force winds or attempts at forced entry.

The prior art requires elaborately shaped and molded end pieces with complex geometries that impose relatively high costs for manufacturing and assembling the shutter. In some cases, such intricately shaped end pieces can be subject to wear and short life.

Moreover, the prior art often describes retention means that comprise separate end pieces to be affixed to the slats by rivets or other means, such that the surface of the slats near the rivet points bear much of the load. This makes such retention means unsuitable for use with plastic and similarly inexpensive slat materials when the shutter must resist pressures of 300 pounds per square foot or more.

Finally, the prior art describes retention means typically comprising one or more slat retention fins substantially perpendicular to the guide track sides which are engaged by flanges or pinheads attached to a slat end. When a displacement force is exerted upon the shutter, the slats bow causing the flange or pinhead to engage the slat retention fins at a single point and an angle, increasing the angle as the slats bow further. Thus, the component of the displacement forces along the slat retention fins tends to cause the flange or pinhead to slip toward the space between the fins, thereby reducing the overall effectiveness of the retention means.

The present invention overcomes these disadvantages by providing a rivetless, low-cost and easily manufactured end retention means suitable for use with a broad variety of slat materials including plastics and foam-filled aluminum and designed such that the slat retention member engages the end retention means at an angle that decreases as the slat further deforms until the slat retention member flushly engages the end retention means.

SUMMARY OF THE INVENTION

The present invention relates to a shutter for a portal opening such as a window or door suitable for protecting the portal opening from hurricane forces, comprising a flexible barrier selectably movable between an extended and a retracted position and a mounting assembly including a guide track disposed on each side of the portal opening to operatively support the flexible barrier. The invention further includes a retention assembly to maintain the flexible barrier in position relative to the portal opening as described more fully hereinafter.

The flexible barrier comprises a plurality of interlocking hollow barrier slats formed on opposite ends thereof. One or more transverse ribs are disposed within the interior of each interlocking hollow barrier slat to reduce the flexibility of the flexible barrier. Further, one or more of the barrier slats may include a substantially rigid reinforcement bar extending substantially the length of the barrier slat for further reducing the flexibility of the flexible barrier.

As previously described, the mounting assembly comprises a pair of guide tracks disposed on opposite sides of the portal opening. Each guide track includes a pair of corresponding guide track sides to cooperatively form a guide channel therebetween with a guide channel opening for receiving a corresponding barrier slat end therethrough.

The retention assembly comprises a first retention means formed in each guide channel and a corresponding second retention means attached to the corresponding barrier slat ends to retain the flexible barrier in operative relationship relative to the guide tracks and the portal opening. Each first retention means comprises a first retention member including an inner first retention member surface extending outwardly from the inner guide track surface of each corresponding guide track side into the guide channel to cooperatively form a retention slot therebetween to receive a portion of the second retention means therethrough as described more fully hereinafter and to form an acute angle between the inner first retention member surface and the corresponding inner guide track surface. Further, each first retention member terminates in a retention engaging contact adjacent to the inner first retention member surface.

Each second retention means comprises an enlarged retention stop element having a substantially flat retention engaging surface attached to the corresponding barrier slat ends of at least one barrier slat by a corresponding elongated interconnecting member.

When operatively assembled, the corresponding elongated interconnecting members extend through the corresponding retention slot such that the corresponding enlarged retention stop elements are disposed toward the inner end portions of the corresponding guide channels inwardly of the corresponding retention engaging contacts. However, when substantial displacement forces such as those of a hurricane or attempted forced entry are exerted inwardly against or outwardly from the portal opening, the flexible barrier is caused to flex from a normally generally flat position to a bowed flexed position such that the second retention means are displaced towards the corresponding first retention means 38 opposite the direction of the displacement forces. The retention engaging surfaces thereby initially engage the corresponding retention engaging contacts until the displacement force increases to a point at which the retention engaging surfaces engage the corresponding inner first retention member surfaces to secure the flexible barrier within the guide tracks of the mounting assembly.

The invention thus resolves the aforementioned problems in construction, assembly and operation. Other advantages, features and objectives will be found throughout the following description, claims and accompanying drawings.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and object of the invention, reference should be made to the following detailed description taken in connection with the accompanying drawings in which.

Similar reference characters refer to similar parts throughout the several views of the drawings.

DETAILED DESCRIPTION OF THE PREFERRED EMBODIMENTS

Figure 1:
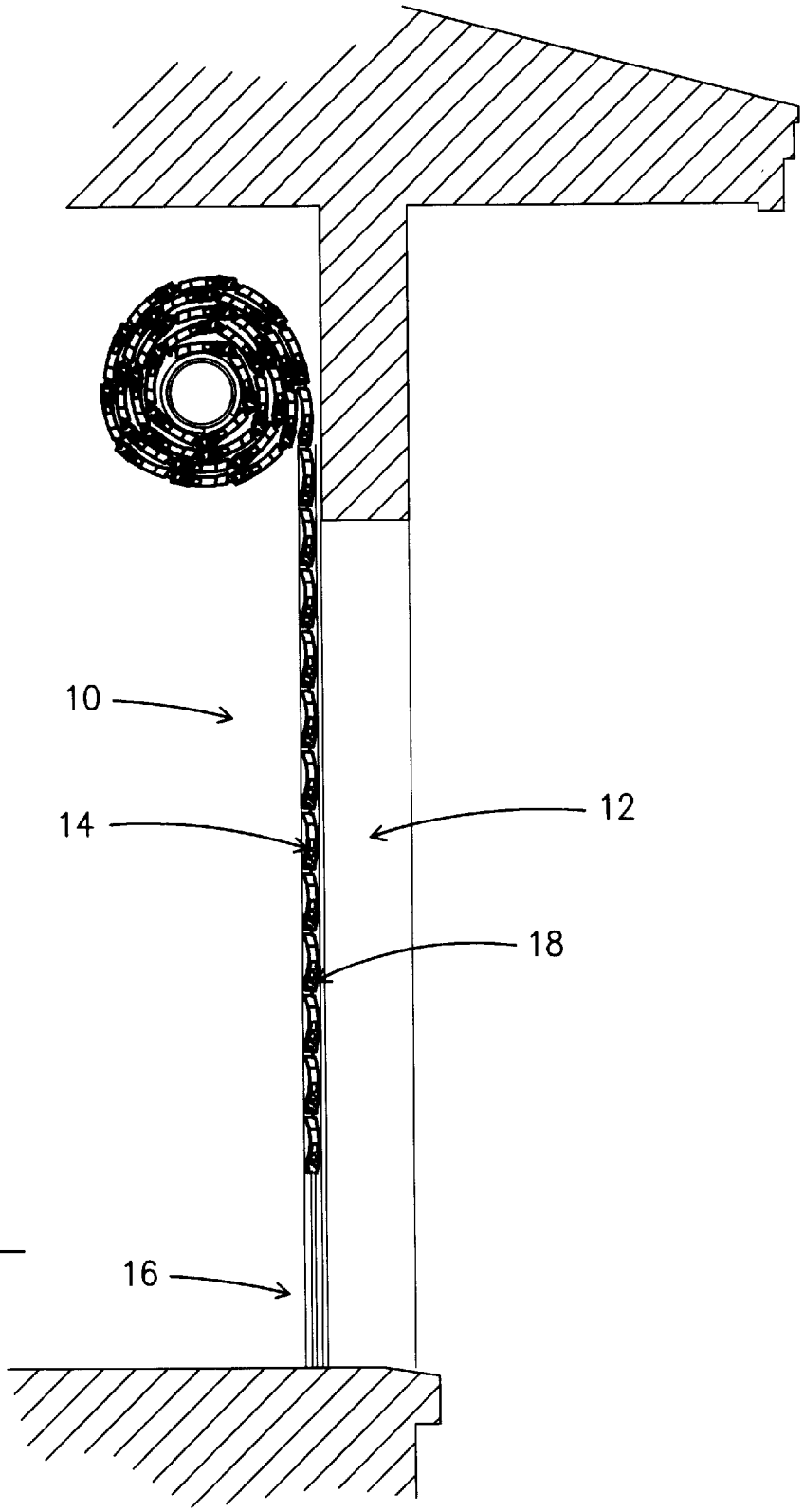
FIG. 1 is a cross-sectional side view of the shutter and portal opening with the flexible barrier in the extended position.
Figure 2:
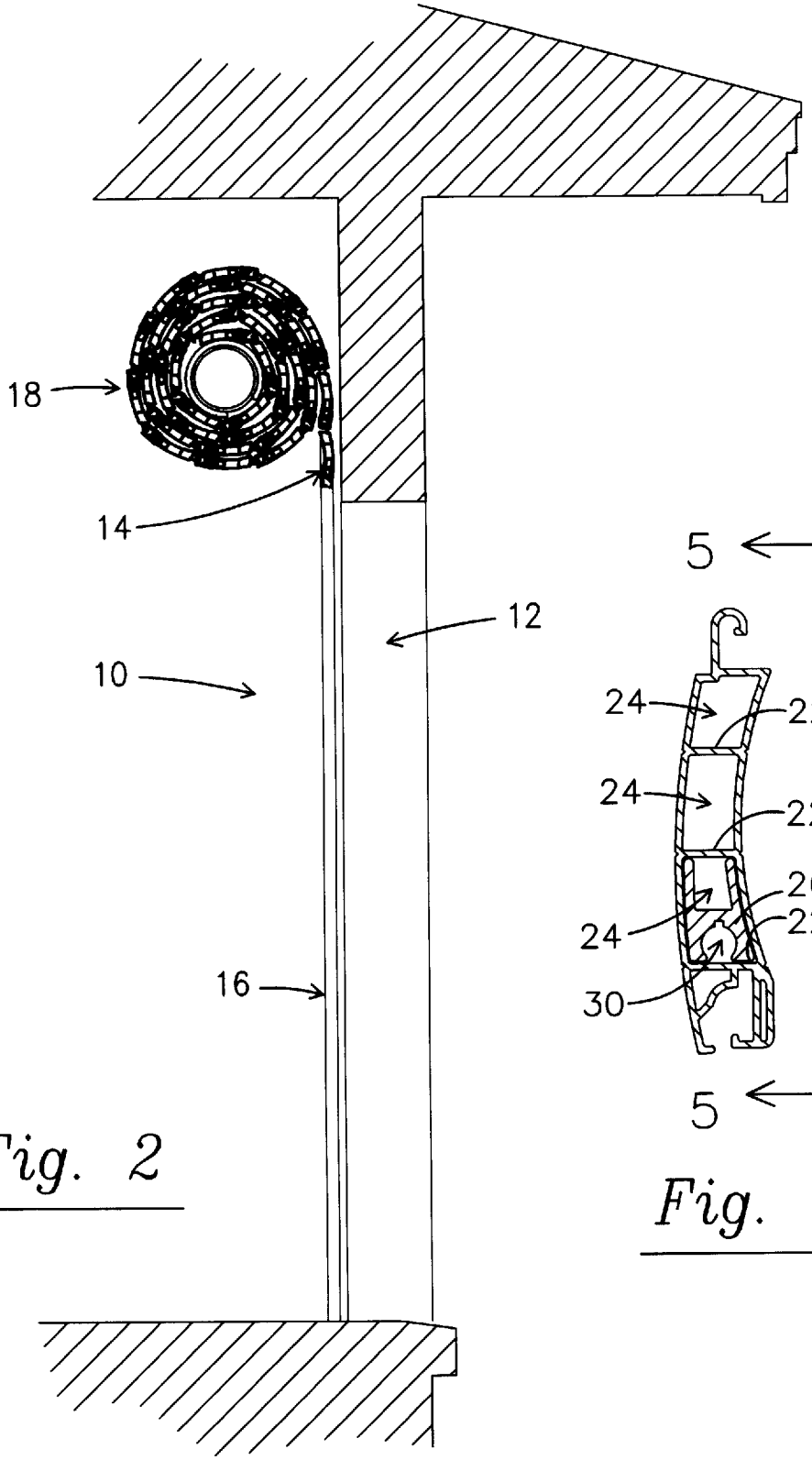
FIG. 2 is a cross-sectional side view of the shutter and portal opening with the flexible barrier in the retracted position.
Figure 6:
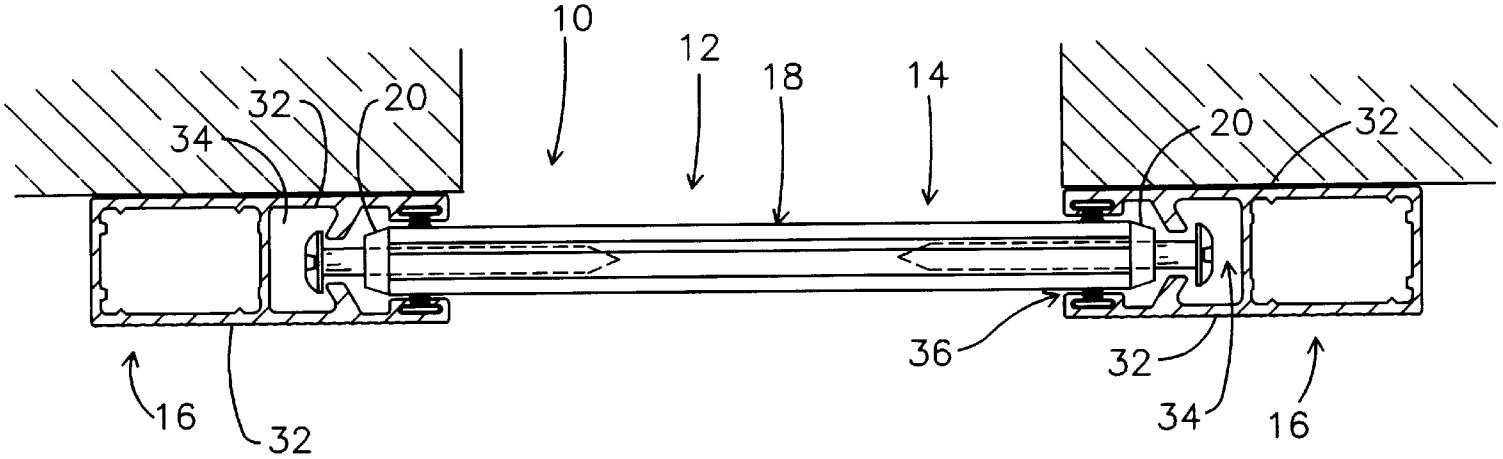
FIG. 6 is a cross-sectional top view of the shutter with the flexible barrier in the normal position.
Figure 7:
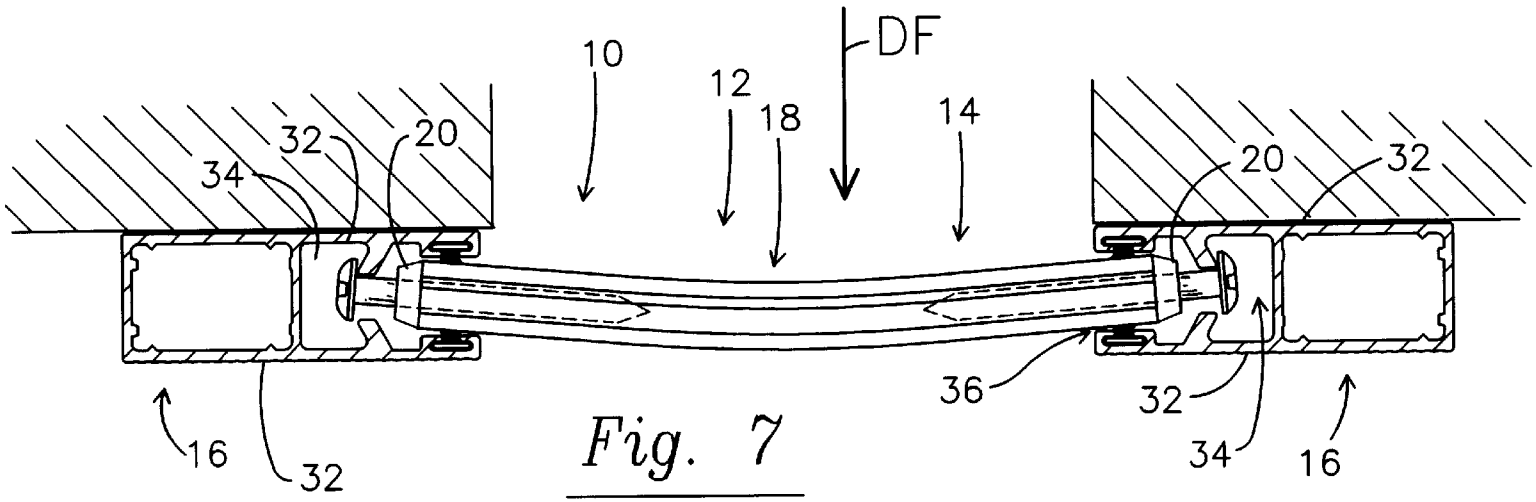
FIG. 7 is a cross-sectional top view of the shutter with the flexible barrier in the bowed position.

As best shown in FIGS. 1 and 2, the present invention relates to a shutter generally indicated as 10 for a portal opening 12 such as a window or door suitable for protecting the portal opening from hurricane forces. As more fully described hereinafter, the shutter 10 includes a flexible barrier generally indicated as 14 selectably movable between an extended position wherein the portal opening 12 is closed as shown in FIG. 1 and a retracted position wherein the portal opening 12 is open as shown in FIG. 2 and a mounting assembly including a guide track generally indicated as 16 as best shown as FIGS. 6 and 7 disposed on each side of the portal opening 12 to operatively support the flexible barrier 14. Further, the flexible barrier 14 is capable of moving or flexing between a normally generally flat position as shown in FIG. 6 and a bowed flexed position as shown in FIG. 7 when a displacement force DF is exerted inwardly or outwardly against the flexible barrier 14. The invention further includes a retention assembly to maintain the flexible barrier 14 in position relative to the portal opening 12 as described more fully hereinafter.

Figure 3:
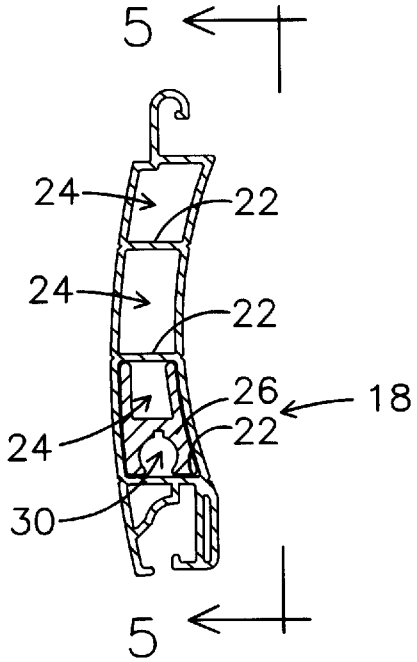
FIG. 3 is detailed cross-sectional side view of a barrier slat and retention bar.
Figure 4:
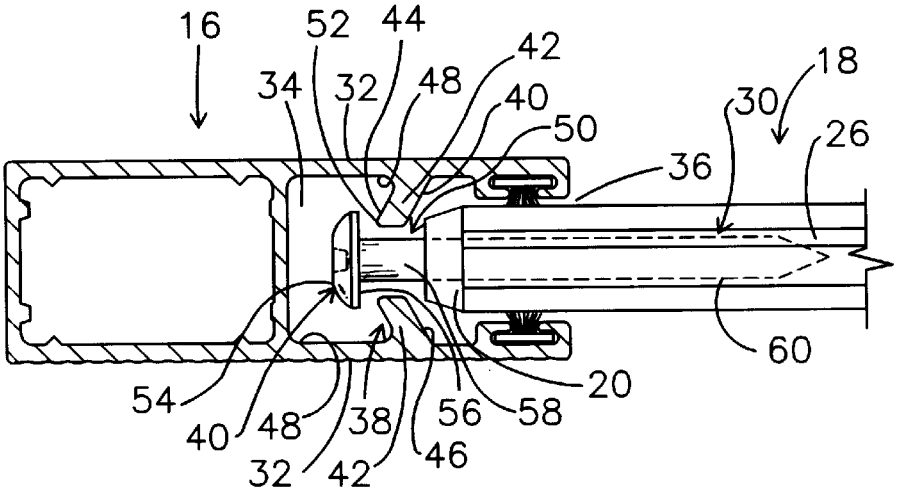
FIG. 4 is a partial detailed cross-sectional top view of a guide track with a barrier slat in the normal position.
Figure 5:
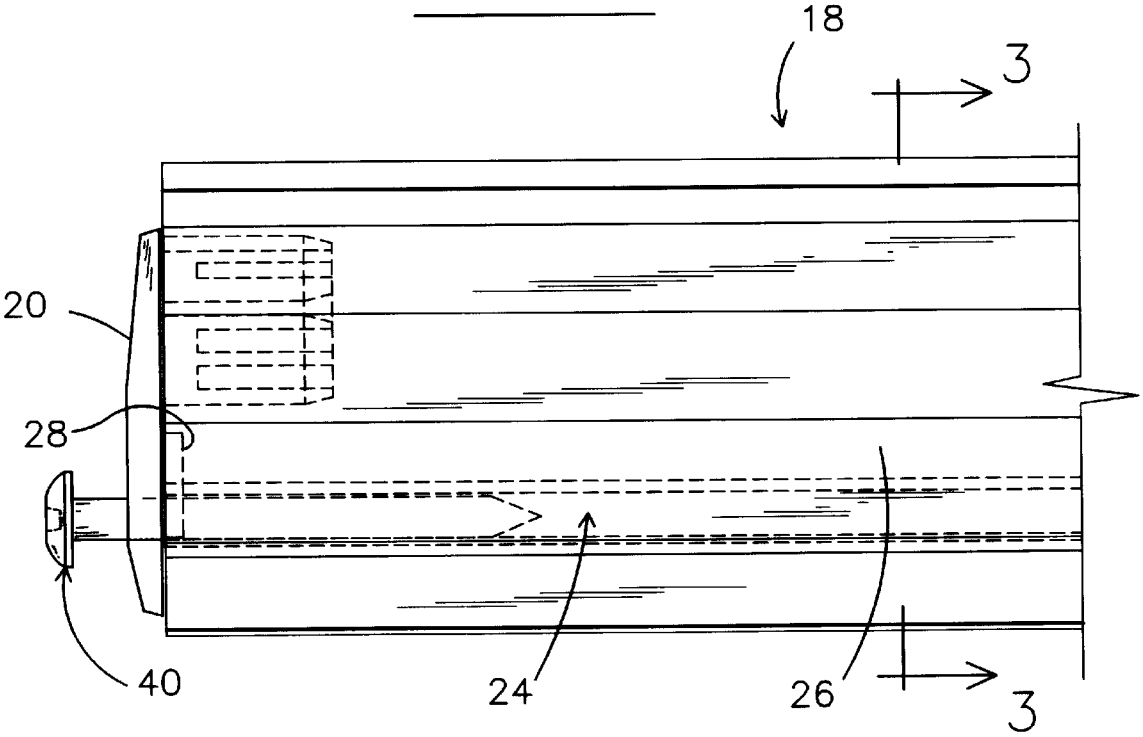
FIG. 5 is a partial detailed front view of a barrier slat with a second retention means attached thereto.

As best shown in FIGS. 3 through 5, the flexible barrier 14 comprises a plurality of interlocking hollow barrier slats each generally indicated as 18 having a barrier slat end 20 formed on opposite ends thereof. As shown, the barrier slat end 20 may include an end cap or a reinforcement bar end 28. One or more transverse ribs each indicated as 22 are disposed within the interior of each interlocking hollow barrier slat 18 dividing each barrier slat into two or more slat compartments each indicated as 24 to reduce the flexibility of the flexible barrier 14. Further, one or more of the barrier slats 18 may include a substantially rigid reinforcement bar 26 having a reinforcement bar end 28 at each end thereof and extending substantially the length of the barrier slat 18 for further reducing the flexibility of the flexible barrier 14. Each rigid reinforcement bar 26 may press fit within the corresponding slat compartment 24 and including an aperture 30 extending therethrough to receive and retain a portion of the retention assembly as described more fully herein. Of course, the aperture 30 may be formed only in the end portions of the rigid reinforcement bar 26.

Alternatively, the interlocking hollow barrier slats 18 may be filled with a foam or similar material capable of hardening sufficiently to receive and retain a portion of the retention assembly therein.

As previously described, the mounting assembly comprises a pair of guide tracks 16 disposed on opposite sides of the portal opening 12. As best shown in FIGS. 4, 6 and 7, each guide track 16 includes a pair of corresponding guide track sides each indicated as 32 to cooperatively form a guide channel 34 therebetween with a guide channel opening 36 for receiving a corresponding barrier slat end 20 therethrough.

As best shown in FIGS. 4, 6 and 7, the retention assembly comprises a first retention means generally indicated as 38 formed in each guide channel 34 and a corresponding second retention means generally indicated as 40 attached to the corresponding barrier slat ends 20 to retain the flexible barrier 14 in operative relationship relative to the guide tracks 16 and the portal opening 12. Each first retention means 38 comprises a first retention member 42 including an inner and outer first retention member surface indicated as 44 and 46 respectively extending outwardly from the inner guide track surface 48 of each corresponding guide track side 32 into the guide channel 34 to cooperatively form a retention slot 50 therebetween to receive a portion of the second retention means 40 therethrough as described more fully hereinafter and to form an acute angle between the inner first retention member surface 44 and the corresponding inner guide track surface 48. The acute angle may vary between about 45° and about 89°. Further, each first retention member 42 terminates in a retention engaging contact 52 adjacent to the inner first retention member surface 44.

Each second retention means 40 comprises an enlarged retention stop element 54 having a substantially flat retention engaging surface 56 attached to the corresponding barrier slat ends 20 of at least one barrier slat 18 by a corresponding elongated interconnecting member 58. The inner end portion 60 of each elongated interconnecting member 58 may be externally threaded to fasten the corresponding second retention means 40 by engagement with the corresponding barrier slat end 20. Alternately, the inner end portion 60 may be embedded in the foam material prior to hardening.

When operatively assembled, the corresponding elongated interconnecting members 58 extend through the corresponding retention slot 50 such that the corresponding enlarged retention stop elements 54 are disposed toward the inner end portions of the corresponding guide channels 34 inwardly of the corresponding retention engaging contacts 52. However, when substantial displacement forces DF such as those of a hurricane or attempted forced entry are exerted inwardly against or outwardly from the portal opening 12, the flexible barrier 14 is caused to flex from a normally generally flat position as shown in FIG. 6 to a bowed flexed position as shown in FIG. 7 such that the second retention means 40 are displaced towards the corresponding first retention means 38 opposite the direction of the displacement forces DF. The retention engaging surfaces 56 thereby initially engage the corresponding retention engaging contacts 52 until the displacement force DF increases to a point at which the retention engaging surfaces 56 engage the corresponding inner first retention member surfaces 44 to secure the flexible barrier 14 within the guide tracks 16 of the mounting assembly.

It will thus be seen that the objects set forth above, and those made apparent from the preceding description are efficiently and cost-effectively attained and since certain changes may be made in the invention, it is intended that all matter contained in the above description or shown in the accompanying drawings shall be interpreted as illustrative and not in a limiting sense.

It is also to be understood that the following claims are intended to cover all of the generic and specific features of the invention which as a matter of language might be said to fall therebetween.

Now that the invention has been described, what is claimed is:

1. A shutter system for a portal opening such as a window or door comprising:

a flexible barrier having an inner surface and an outer surface including a plurality of interlocking flexible barrier slats, a mounting assembly having a guide track disposed on each side of the portal opening, each said guide track including a pair of guide track sides each having an inner guide track surface, a retention assembly to retain said flexible barrier to said mounting assembly when an extreme force is exerted against said inner or outer surface of said flexible barrier, said retention assembly comprising:

a first retention means including a first retention member having an inner retention member surface extending outwardly from said corresponding inner guide track surface of each said guide track and away from the portal opening to cooperatively form a retention slot therebetween, said inner retention member surface being inclined relative to said corresponding inner guide track surface to form an acute angle therebetween; and a second retention means including a stop element having a retention engaging surface attached to opposite ends of said flexible barrier, each said first retention member further including a retention engaging contact formed on the inner end portion thereof to initially engage said corresponding retention engaging surface closest to the direction of a displacement force when the displacement force causes said flexible barrier to flex to secure said flexible barrier to said mounting assembly.

2. The shutter system in claim 1 wherein said acute angle is between about 45° and about 89°.

3. The shutter system in claim 1 wherein a part of each said interconnecting member is externally threaded, each said barrier slat is hollow having at least one transverse rib dividing said slat into at least two slat compartments with a reinforcement bar extending therethrough, said elongated interconnected members secured to opposite ends of said barrier slat to attach said second retention means to said corresponding barrier slats.

4. The shutter system in claim 1 wherein at least one of said barrier slats is hollow and filled with a foam capable of hardening sufficiently to secure said interconnecting members to said barrier slats.

5. The shutter system in claim 4 wherein said interconnecting member is externally threaded to fasten said corresponding second retention means to said corresponding barrier slat by engagement with said foam.

6. The shutter system in claim 1, wherein the angle formed between said retention engaging surface and said corresponding inner retention member surface at said corresponding retention engaging contact decreases as the displacement force increases until said retention engaging surface and said corresponding inner retention member surface are disposed in substantially parallel relationship relative to each other to securingly engage one another.

7. A shutter system for a portal opening such as a window or door comprising:

a flexible barrier having an inner surface and an outer surface including a plurality of interlocking flexible barrier slats, a mounting assembly having a guide track disposed on each side of the portal opening, each said guide track including a pair of guide track sides each having an inner guide track surface, a retention assembly to retain said flexible barrier to said mounting assembly when an extreme force is exerted against said inner or outer surface of said flexible barrier, said retention assembly comprising:

a first retention means including a first retention member having an inner retention member surface extending outwardly from said corresponding inner guide track surface of each said guide track and away from the portal opening to cooperatively form a retention slot therebetween, said inner retention member surface being inclined relative to said corresponding inner guide track surface to form an acute angle therebetween; and a second retention means including a stop element having a retention engaging surface attached to opposite ends of said flexible barrier, each said first retention member further including a retention engaging contact formed on the inner end portion thereof to initially engage said corresponding retention engaging surface closest to the direction of a displacement force when the displacement force causes said flexible barrier to flex to secure said flexible barrier to said mounting assembly, such that the angle formed between said retention engaging surface and said corresponding inner retention member surface at said corresponding retention engaging contact decreases as the displacement force increases until said retention engaging surface and said corresponding inner retention member surface are disposed in substantially parallel relationship relative to each other to securingly engage one another.

8. The shutter system in claim 7, wherein said acute angle is between about 45 degrees and about 89 degrees.

9. The shutter system in claim 7, wherein each said second retention means further includes an interconnecting member, a part of each said interconnecting member is externally threaded, at least one of said barrier slats is hollow having at least one transverse rib dividing said slat into at least two slat compartments with a reinforcement bar extending therethrough, said elongated interconnected members secured to opposite ends of said barrier slat to attach said second retention means to said corresponding barrier slats.

10. The shutter system in claim 7, wherein each said second retention means further includes an interconnecting member, at least one of said barrier slats is hollow and filled with a foam capable of hardening sufficiently to secure said interconnecting members to said barrier slats.

11. The shutter system in claim 10, wherein said interconnecting member is externally threaded to fasten said corresponding second retention means to said corresponding barrier slat by engagement with said foam.

12. The shutter system in claim 11, wherein said acute angle is between about 45 degrees and about 89 degrees.

* * * * *